United States Patent [19]

Zaruba

[11] Patent Number: 4,476,649

[45] Date of Patent: Oct. 16, 1984

[54] TOY DOLL STROLLER AND FERRIS WHEEL

[75] Inventor: John V. Zaruba, Chicago, Ill.

[73] Assignee: Marvin Glass & Associates, Chicago, Ill.

[21] Appl. No.: 451,174

[22] Filed: Dec. 20, 1982

[51] Int. Cl.[3] ..... A63H 5/00

[52] U.S. Cl. ..... 446/114

[58] Field of Search ..... 46/204, 205, 201, 114, 46/202, 47, 210, 46

[56] References Cited

U.S. PATENT DOCUMENTS

| | | | |
|---|---|---|---|
| 311,215 | 1/1885 | Webb | 46/205 |
| 1,396,109 | 11/1921 | Grimsley | 46/205 |
| 2,441,906 | 5/1948 | Sagat | 46/204 |
| 2,496,603 | 2/1950 | Schwanengel | 46/204 |
| 2,685,148 | 8/1954 | Fisher et al. | 46/114 |
| 3,008,265 | 11/1961 | Converse | 46/114 X |

*Primary Examiner*—Mickey Yu

*Attorney, Agent, or Firm*—John S. Pacocha

[57] ABSTRACT

A toy doll stroller and ferris wheel has a pair of substantially A-shaped frame members with a U-shaped handle extending from and joining the frame members. Spaced side wheels mounted on a hollow axle are journaled for rotation between the apexes and carry three pivotally depending doll seats spaced about their periphery. Free wheeling front ground wheels are mounted on an axle extending between the forward angled legs of the frame members. Each of a pair of rear ground wheels is mounted on a stub shaft carried by the rearward angled frame leg on a common axis and is in driving engagement with a respective side wheel. The rearward angled legs are connected together by a U-shaped bracket of resilient material pivotally attached below the axis of the stub shafts. The bracket is movable between a first unobstructing position and a second stand position that spaces the rear wheels from the ground. One of the rear wheels has a hand crank to drive the ferris wheel while the bracket is in the stand position and the stroller remains stationary. Chimes or other musical note-producing devices may be carried in the hollow axle.

20 Claims, 7 Drawing Figures

Fig 1
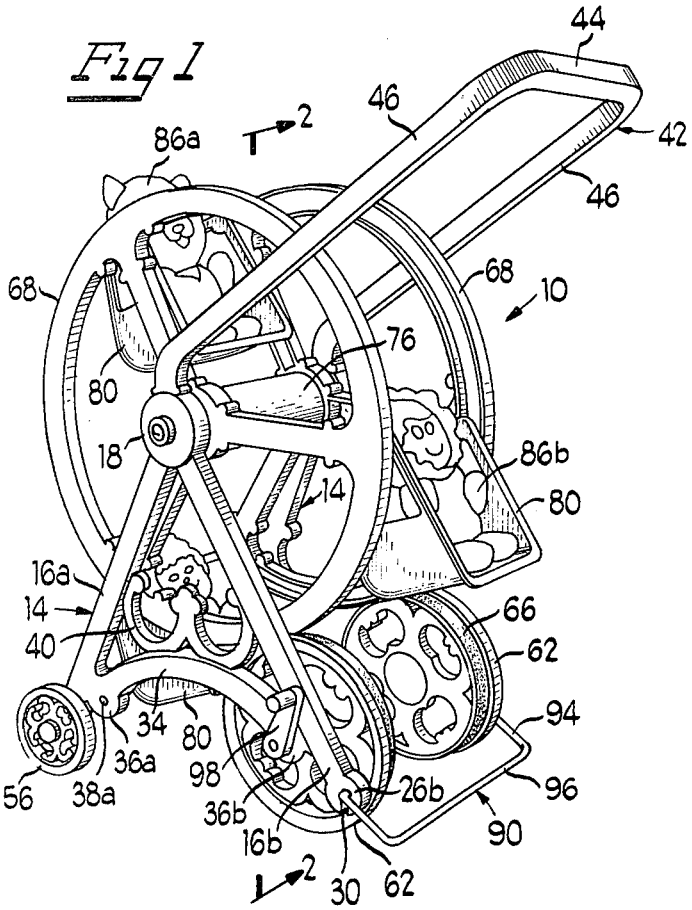
Fig 3
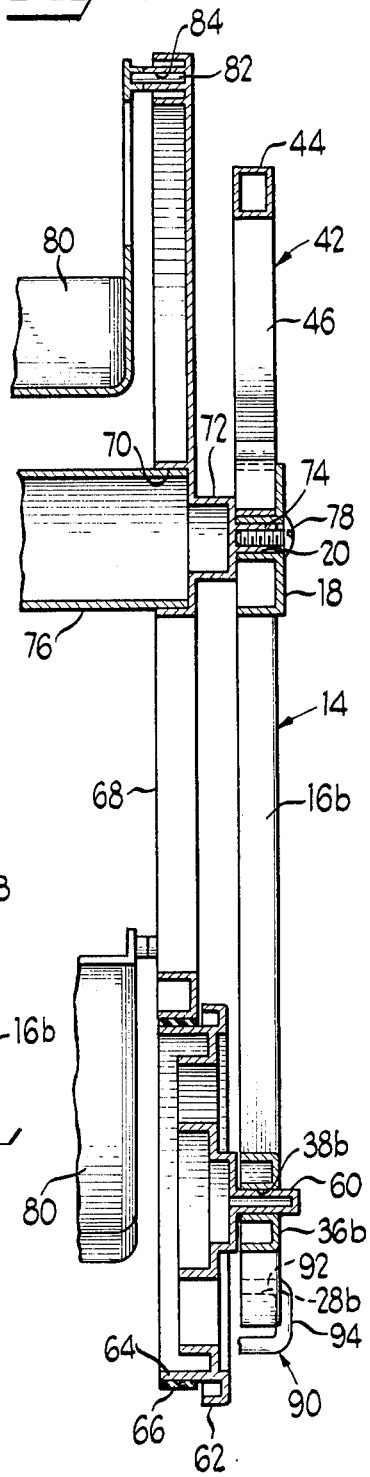
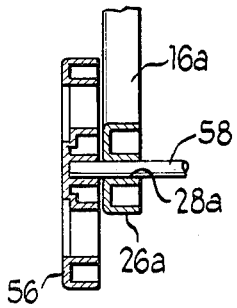
Fig 6
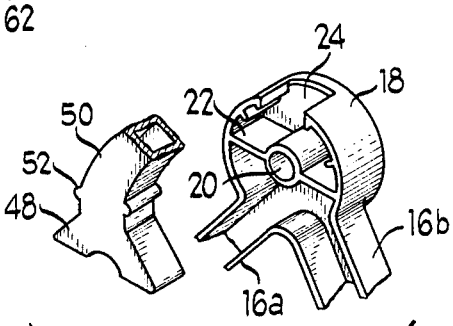
Fig 7

3
44
46
80
68
50
76
16a
16b
14
40
80
80
34
6
56
58
38a
36a
26a
66
38b
36b
64
62
94
96
26b 98
6
34
36b
16b
26b
30
96

34
16b
3
36b
98
26b
32
96

TOY DOLL STROLLER AND FERRIS WHEEL

BACKGROUND OF THE INVENTION

1. Field of the Invention

This invention relates generally to doll accessories and more particularly to toy strollers.

2. Background Art

Toy strollers have long been popular doll accessories. Many prior art toy strollers seek to emulate the real-life counterparts. There have also been prior art strollers which include a whimsical feature to add to the entertainment and enjoyment of the toy such as Coleco Merry-Go-Round stroller. That toy has two ground wheels on a substantially horizontal axis with a right angle transmission to drive a vertically extending shaft on which two doll seats are carried for rotation in a substantially horizontal plane. The dolls are twirled around in a carousel fashion as the stroller is pushed. However, there remains a need for additional toy strollers that have a movable feature driven by trouble-free mechanisms.

SUMMARY OF THE INVENTION

The present invention is concerned with providing a multi-featured toy stroller that includes a ferris wheel powered by a direct drive mechanism from the ground wheels when the stroller is pushed along a surface. The ferris wheel feature can also be played with when the stroller is stationary. These and other objects and advantages of the invention are achieved by providing a frame assembly with ground engaging drive wheels on coaxial stub shafts and having one or both of those wheels directly drive a ferris wheel journaled on the frame assembly on an axis parallel to those of the stub shafts. In addition, a stand is pivotally connected to the frame to permit the drive wheels to be moved out of engagement with the ground surface so that at least one ground wheel may be turned by a hand crank to rotate the ferris wheel while the stroller is stationary.

BRIEF DESCRIPTION OF THE DRAWINGS

For a better understanding of the present invention reference may be had to the accompanying drawings in which:

FIG. 1 is a perspective view of an embodiment of the present invention;

FIG. 3 is a fragmentary sectional view taken substantially along line 3—3 of FIG. 2;

FIG. 6 is a fragmentary sectional view taken substantially along line 6—6 of FIG. 2; and FIG. 7 is a fragmentary exploded perspective view showing the portions of the end of the U-shaped handle and apex of the A-shaped frame that fit together.

DETAILED DESCRIPTION OF THE PREFERRED EMBODIMENT

Figures 2, 4, 5:
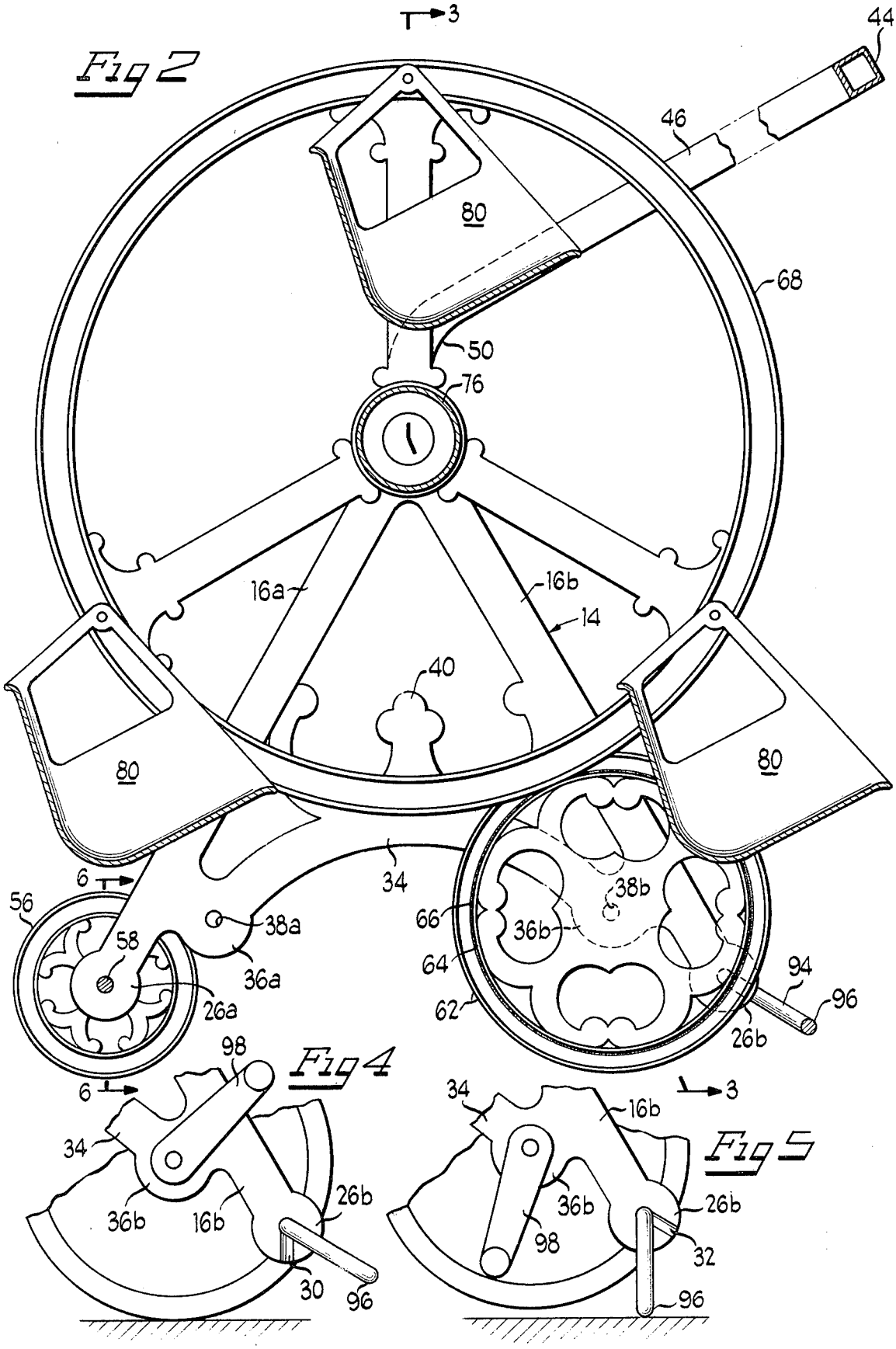
FIG. 2 is an enlarged sectional view taken substantially along line 2—2 of FIG. 1.
FIG. 4 is a fragmentary view showing the left rear wheel with the crank and stand in one position.
FIG. 5 is a fragmentary view showing the left rear wheel with the crank and stand in a second position.

Referring now to the drawings in which like parts are designated by like reference characters throughout the several views, there is shown in FIG. 1 a toy doll stroller and ferris wheel combination 10. Supporting the combination is a pair of basically A-shaped members 14 which are identical for convenient manufacturing and assembly.

Each of the frame members 14 has a pair of angled legs **16*a* and 16*b* which intersect at an apex boss 18. A central bore 20 extends through the apex boss which has a C-shaped cavity 22 on its back face and a blind slot 24 on the top of the boss 18 open toward the back side of the frame member 14 and communicating with the cavity 22. At the diverging bottom ends of each of the legs 16*a* and 16*b* are formed respective bottom bosses 26*a* and 26*b*. Bores 28*a* and 28*b* extend through the bosses 26*a* and 26*b* respectively and each of the bosses has a pair of detents or depressions 30 and 32 formed on the front face and extending radially from the bore 28 to the periphery of the boss. As is best shown in FIGS. 4 and 5, the detents are spaced approximately 45 degrees apart. A curved cross-piece 34 joins the angled legs 16 near their diverging ends. The piece 34 also has a pair of bosses 36*a* and 36*b* adjacent the intersection with the angled legs 16*a* and 16*b*. Each of the bosses 36*a* and 36*b* has a respective bore 38*a* and 38*b* extending through the boss. Scroll work 40 provides additional strength for the A-frame member in addition to decorating it The tops of the two A-frame members are joined together by a one-piece essentially U-shaped handle 42. Bight 44 of the handle forms the hand grip portion and projects out beyond the diverging back bottom ends of the angled legs 16*b*. The substantially parallel uprights 46 of the handle 42 lie in substantially the same planes as the A-frame members 14. Just before the inverted Y-shaped ends 48 of each of the uprights 46 is a downward, approximately 120-degree, bend 50. A rim 52 extends around the upright 46 between the bend 50 and the end 48. Upright 46 will fit into the blind slot 24 with the inverted Y ends 48 received in the C-shaped cavity 22. The rim 52 supports the handle 42 on the outside surface of the apex bosses 18. Alternatively, a U-shaped handle may have each of its uprights connected by a bracket across a respective rearwardly angled leg 16*b* of the A-frame at a convenient point between the apex boss 18 and boss 36*b*. In such an alternative assembly, the end of the upright could be attached to the center of the scroll work 40** for additional support.

A pair of front wheels 56 are press fitted on an axle 58 that is journaled for rotation in the bottom bores **28*a* of the forward angled legs 16*a*. (It will be appreciated that it could instead be said that the axle 58 is journaled through the bore 28*a* of one frame member 14 and 28*b* of the opposite side frame member which is the identical same piece that has been flipped around.) Substantially coaxial rear stepped hub and stub shafts 60 are journaled for rotation in the bores 38*b* substantially parallel to front axle 58. Integrally formed with the hub and stub shafts 60 are rear ground wheels 62 and slightly smaller diameter, concentric, inboard facing drive cylinders 64 with a rubber, or other friction increasing material, covering 66 that does not engage the ground. A cap (not shown) over the free outboard end of the stub shaft 60** secures it.

Each of a pair of parallel large diameter side wheels 68 has an integrally formed stepped bore 70, spur 72, and gudgeon 74. Side wheels 68 are spaced from each other by a hollow axle 76 the ends of which are secured into the bores 70. Each of the gudgeons 74 are inserted in a respective bore 20 in the apex boss 18 of a frame member 14 and secured by a screw 78 or a through-extending metal shaft to rotatably support the side wheels 68 on an axis substantially parallel to that of the stub shafts 60. As is best shown in FIG. 3 the side wheels 68 are spaced from the frame 14 so that the side wheels 68 lie in substantially the same plane as the drive cylinders 64. The sum of the radii of the side wheels 68 and the drive cylinder 64 is substantially equal to the distance from the central bore 20 to the bottom bore 28*b* along the angled leg 16*b*. Therefore, the periphery of each side wheel 68 is in contact with the rubber coated surface 66 on the respective drive cylinder 64 effecting a frictional drive transmission. Accordingly, when the stroller is pushed along the ground, the rotation of the rear ground engaging wheels 62 will rotate the concentric drive cylinder 64 and in turn rotatingly drive the side wheels 68. The downward force normally exerted on the bight portion 44 of the handle will help force the side wheels 68 into frictional engagement with the rubber covered surface 66. It will be appreciated to those skilled in the art that other transmission means such as gear teeth on a side wheel 68 meshing with gear teeth on a respective drive cylinder 64 could be employed without departing from the object of this invention to provide a relatively uncomplicated trouble-free drive mechanism for the ferris wheel.

Three one-piece molded doll seats 80 are pivotally mounted at approximately equally spaced intervals between the side wheels 68 adjacent the periphery of the side wheels and parallel to the axis through the axle 76 and the gudgeons 74. Each of the seats 80 carries a pair of trunnions 82 extending outwardly near the top of the seat back. The trunnions 82 are received in sleeves 84 molded in the side wheels 68 or in holes in the side wheels. As the side wheels 68 rotate, the seats will go around in a circle while freely pivoting about the trunnions 82 to maintain the seats in a generally upright position throughout rotation. The length of each seat 80 is limited by the distance from the trunnions 82 to the periphery of the axle 76 and also by the distance from the trunnions to the ground. By spacing the periphery of the side wheels 68 at least the length of the radius of the wheels 62 from the ground, a large enough seat 80 may be used to accommodate a convenient size doll without hitting the ground. Since the rear drive wheels 62 are mounted on the stub shafts 60, the seat may swing between the rear wheels as the side wheels 68 rotate. While virtually any number of seats 80 could be employed, three has been found to be a convenient number which provides a fairly frequent rotation of the child's dolls 86 coming up over the ferris wheel to face the child pushing the stroller and still provide sufficient intervals between the seats so as not to require a great number of dolls to enjoy playing with the stroller.

A bracket 90 is formed of a resilient material in a general U-shape. The ends 92 of the upright legs 94 of the bracket are bent back in toward the center of the "U". Accordingly, when the ends are spread apart, they may be fitted into the rear bottom bores 28*b*. The resiliency of the bracket 90 will retain the uprights 94 against the outside front surface of the respective rear bottom boss 26*b* to connect the legs 16*b* while permitting pivotal movement of the bracket 90. Since only stub shafts 60 are used for the rear wheels 62 instead of a through-extending axle like front axle 58, a tie bolt (not shown) between the bottom bosses 26*b* may be used if the bracket 90 is not used.

Detents 30 and 32 limit the positioning of the pivotally mounted bracket 90 since the resiliency will force the uprights 94 into the detents. Accordingly, when the uprights 94 are in the detents 32, as shown in FIG. 4, the bracket is up and out of the way. However, when the uprights 94 are moved out of the detents 32 to the substantially vertical detents 30, as shown in FIG. 5, the bight portion 96 of the U-shaped bracket will engage the ground and raise the rear wheels 62 out of engagement with ground. With the bracket 90 positioned as in FIG. 5 functioning as a stand, a rear wheel may be rotated by means of the hand crank 98 that is secured to the stub shaft 60 of one of the rear wheels 62 for rotation with the shaft and in turn drive the side wheels 68 providing an alternative play feature with the ferris wheel while the stroller is stationary.

Chimes with a freely movable striker (not shown) may be included within the hollow axle 76 to provide musical notes as the ferris wheel is rotated.

While there has been shown and described a particular embodiment of the present invention, it will be apparent to those skilled in the art that various changes and modifications may be made without departing from the true spirit and scope of the present invention and it is intended in the appended claims to cover all such changes and modifications.

What is claimed as new and desired to be secured by Letters Patent is:

1. A stroller comprising:
spaced parallel members forming a frame;
a pair of ground engaging wheels, each mounted for rotation of a stub shaft extending inwardly from a respective frame member to form a common axis;
means extending between the frame members below the common axis to connect the frame members together proximate the ground engaging wheels;
a pair of spaced side wheels mounted on an axle and carried by the frame for rotation with the periphery of the side wheels spaced from the ground;
a concentric, inwardly disposed drive wheel portion on one of the ground engaging wheels in direct drive engagement with the periphery of one of the side wheels;
a plurality of pivot means on the spaced side wheels spaced at approximately the same distance from the axle and at approximately equal intervals;
a seat pivotally depending from each of the pivot means between the spaced side wheels and passing between the ground engaging wheels below the common axis during rotation of the spaced side wheels;
the length of the seat depending from the pivot means being less than the distance between the pivot means and the axle and less than the distance the side wheel periphery is spaced from the ground; and
handle means connected to the frame members projecting upwardly from the ground and outwardly from the frame.

2. The toy stroller of claim 1 in which the side wheels are spaced from the ground a distance that is at least equal to the radius of the ground engaging wheels.

3. The toy stroller of claim 2 in which
the length of the seat depending from the pivot means is greater than the radius of the ground engaging wheels.

4. The toy stroller of claim 1 in which:
the axle for the side wheels is journaled for rotation in the frame;
the axle for the spaced side wheels is hollow; and means for producing sound upon rotation of the side wheels are disposed within the hollow axle.

5. The toy stroller of claim 1 in which the means extending between the frame members comprises an essentially U-shaped bracket having each upright pivotally connected to a respective frame member such that the bight portion of the bracket engages the ground when the bracket is in a stand position.

6. The toy stroller of claim 5 in which:

the bracket raises the frame and prevents the ground engaging wheels from engaging the ground when the bracket is in the stand position; and crank means are provided on the one ground wheel for manually rotating the ground wheel to drive the side wheel when the bracket is in the stand position.

7. The toy stroller of claim 1 including ground support means mounted on the frame and spaced transversely from the common axis.

8. The toy stroller of claim 7 in which:

the members are substantially A-shaped;

the axle is carried between the apex of each of the members;

the ground wheels are mounted adjacent the lower portion of one of the angled legs of the frame members; and the ground support means is a second set of ground engaging wheels mounted on an axle that is supported by the frame members adjacent the lower end of the other angled leg.

9. The toy stroller of claim 8 in which:

the handle means has a pair of substantially parallel uprights; and each of the uprights is connected to a respective frame member at the apex.

10. The toy stroller of claim 8 in which:

the handle means has a pair of substantially parallel uprights; and each of the uprights is connected across one of the angled legs of a respective frame member between the apex and the lower portion adjacent which the ground wheel is mounted.

11. The toy stroller of claim 7 in which:

the ground support means comprises a second pair of ground wheels;

the second pair of ground wheels is mounted on a second axle substantially parallel to the common axis; and the second axle is carried by the frame members.

12. The toy stroller of claim 8 in which the axle on which the second sets of ground engaging wheels are mounted extends between and connects the frame members.

13. The toy stroller of claim 1 in which the drive means comprises a friction contact drive transmission.

14. The toy stroller of claim 13 in which the one ground engaging wheel has a rubber-covered portion that contacts and drives the one side wheel.

15. The toy stroller of claim 1 in which the one concentric drive wheel has gear teeth and the one side wheel has gear teeth that are in driving transmission.

16. A toy stroller comprising;

parallel spaced members forming a frame;

first axle means mounted in the frame and defining an axis of rotation;

a pair of ground wheels mounted on the first axle means;

the ground wheels being rotatable;

ground support means carried by the frame spaced from the ground wheels in a direction perpendicular to the axis;

handle means connected to the frame members and projecting upwardly from the ground wheels and outwardly from the frame;

second axle means supported by the frame;

the second axle means being spaced from and substantially parallel to the axis;

a pair of spaced side wheels mounted on the second axle means;

both side wheels being rotatable;

pivot means radially spaced from and parallel to the second axle means on the spaced side wheels;

a seat pivotally depending from the pivot means between the spaced side wheels;

drive means engaging one of the ground wheels with one of the spaced side wheels;

a stand means pivotally connected to the frame for movement from a first unobstructing position in which the stand means does not interfere with the ground wheels and a second elevating position in which the stand means raises the frame and prevents the ground wheels from engaging the ground; and crank means on the one ground wheel for manually rotating the ground wheel to drive the side wheel when the stand means is in the second position.

17. The toy stroller of claim 16 in which the first axle means comprises a pair of coaxial stub shafts, each mounted in a respective frame member.

18. The toy stroller of claim 17 in which the pivot means is connected between the side wheels adjacent the periphery of the wheels and the depending seat extends beyond the periphery.

19. The toy stroller of claim 16 in which the stand means comprises an essentially U-shaped bracket having each upright pivotally connected to a respective frame member such that the bight portion of the bracket engages the ground when the bracket is in the second position.

20. The toy stroller of claim 16 in which:

the second axle means is journaled for rotation in the frame;

the second axle means is hollow; and means for producing sound upon rotation of the second axle means are disposed within the second axle means.

* * * * *